United States Patent [19]

Shriver

[11] Patent Number: 5,003,875

[45] Date of Patent: Apr. 2, 1991

[54] FOUNTAIN ROLL AND ASSEMBLY FOR CAN DECORATING APPARATUS

[75] Inventor: Frank L. Shriver, Lakewood, Colo.

[73] Assignee: Adolph Coors Company, Golden, Colo.

[21] Appl. No.: 322,514

[22] Filed: Mar. 13, 1989

[51] Int. Cl.[5] ..... B41F 31/04; B41F 31/06

[52] U.S. Cl. ..... 101/350; 101/365

[58] Field of Search ..... 101/364, 350, 363, 351, 101/352, 148, 207-210, 157, 169, 365

[56] References Cited

U.S. PATENT DOCUMENTS

| | | | |
|---|---|---|---|
| 2,085,185 | 6/1937 | Crafts . | |
| 2,140,950 | 12/1938 | Blackley | 101/365 |
| 2,359,640 | 10/1944 | Harley | 101/365 |
| 3,073,240 | 1/1963 | Tyma, Jr. et al. | 101/364 X |
| 4,441,418 | 4/1984 | Hahn . | |
| 4,741,266 | 5/1988 | Stirbis et al. . | |

*Primary Examiner*—J. Reed Fisher

*Attorney, Agent, or Firm*—Klaas & Law

[57] ABSTRACT

A fountain roll and assembly for a can decorating apparatus wherein a pan holding a supply of ink is adjustably mounted on a fixed frame so that the level of the supply of ink is generally in a horizontal plane and a fountain roll rotatably mounted in the fixed frame and located so that the lower portion of its outer peripheral surface as it rotates is immersed in the supply of ink and wherein the fountain roll is rotated so that it enters the supply of ink in a generally downward direction and leaves the supply of ink in a generally upward direction. A plurality of doctor blades in a side-by-side contacting relationship are located to remove an excess amount of ink on the outer peripheral surface and to return such excess amount to the supply of ink. The doctor blades are mounted in a unit which is laterally and pivotally adjustable. Also, the doctor blades are individually adjustable in linear directions toward or away from the outer peripheral surface of the fountain roll.

18 Claims, 3 Drawing Sheets

FIG. 6
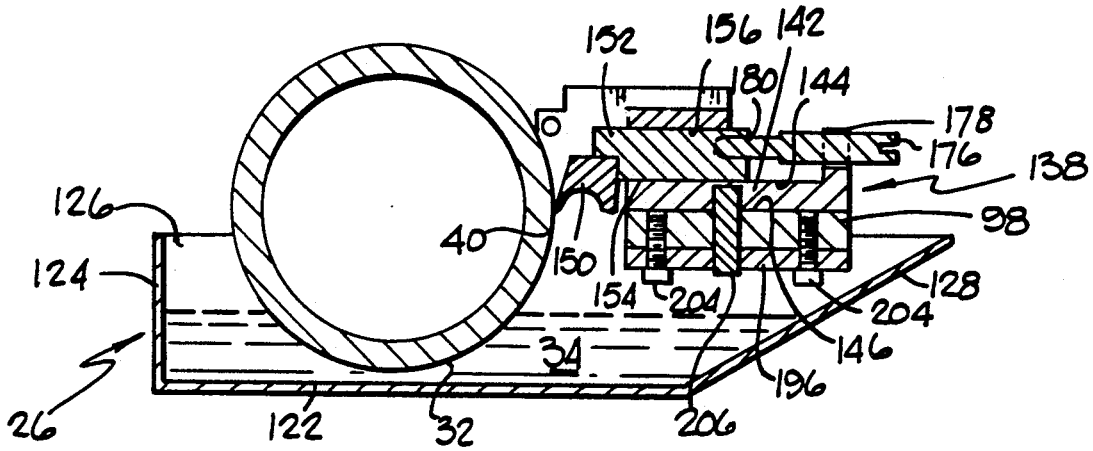
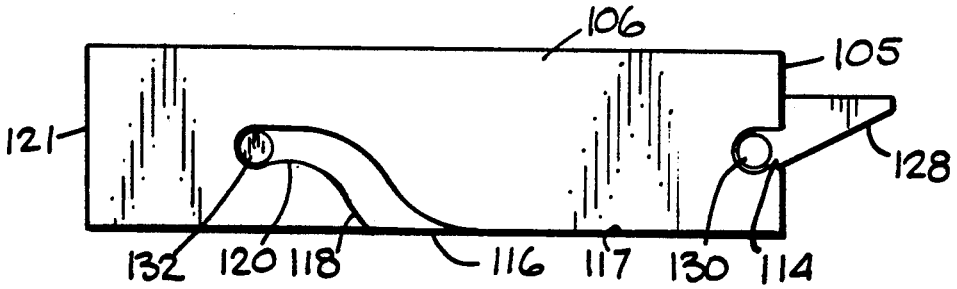
FIG. 7

FOUNTAIN ROLL AND ASSEMBLY FOR CAN DECORATING APPARATUS

FIELD OF THE INVENTION

This invention relates generally to can decorating apparatus and more particularly to fountain roll and assembly for use in such can decorating apparatus.

BACKGROUND OF THE INVENTION

A can decorating apparatus is described and illustrated in U.S. Pat. No. 4,741,266 the disclosure of which is incorporated herein by reference. As illustrated in FIG. 1 of the U.S. Pat. No. 4,741,266, there are a plurality of circumferentially spaced ink transfer roll and fountain stations for supplying ink to separate individual blanket segment means through an equal number of plate cylinder means at six separate inking stations during rotation of the blanket means. Each of these stations has a fountain roll and assembly for receiving and transferring the ink to be used in the can decorating apparatus wherein a fountain roll rotates through a housing having a supply of ink in an upper portion thereof The fountain roll moves through the housing from the upper portion thereof to the lower portion thereof. An adjustable doctor blade is mounted in the lower portion of the housing to remove excess ink from the fountain roll just prior to its exiting the housing. Throughout many years, various problems have been associated with such fountain rolls and assemblies, such as leaking of the ink out of the housing, uneven amounts of ink on the fountain roll and generation of heat which is detrimental to the ink. While many attempts have been made to solve these problems, there exists a need for a good solution.

BRIEF DESCRIPTION OF THE INVENTION

This invention provides a fountain roll and assembly for coating the outer surface of a fountain roll with an even coating of the correct amount of ink and wherein any excess amount of ink removed from the fountain roll is retained completely in the assembly.

In the preferred embodiment of the invention, the fountain roll and assembly comprises a pair of spaced apart fixed frame members on which pan means having a supply of ink are adjustably supported so that the level thereof is generally in a horizontal plane. A fountain roll having a generally cylindrical outer peripheral surface for contacting said supply of ink is rotatably mounted on the frame members on a fixed axis so that the lower portion of the outer peripheral surface as the fountain roll rotates is immersed in the supply of ink. The fountain roll is rotated so that it enters the supply of ink while moving in a generally downward direction and leaves the supply of ink while moving in a generally upward direction. Doctor blade means are provided for contacting the coating of ink on the outer peripheral surface of the fountain roll after it leaves the supply of ink to remove excess ink and leave an even coating of ink on the outer peripheral surface. The pan means has a horizontal cross-sectional configuration that is substantially larger than the horizontal cross-sectional configuration of the fountain roll and the doctor blade means so that all of the removed excess ink is returned to the supply of ink in the pan means. The doctor blade means comprises a plurality of doctor blades in side-by-side contacting relationship which are mounted for individual linear adjustment in one direction and as a unit for linear adjustment in a direction perpendicular to the one direction and also for pivotal movement. A ductor roll is mounted so that it can be moved into and out of contact with the layer of ink on the outer peripheral surface so as to remove a portion of such ink.

BRIEF DESCRIPTION OF THE DRAWINGS

An illustrative and presently preferred embodiment of the invention is shown in the accompanying drawings in which:

FIG. 6 is a cross-sectional view illustrating the coating of the fountain roll; and FIG. 7 is a side elevational view illustrating the mounting of the pan means.

DETAILED DESCRIPTION OF THE INVENTION

Figure 1:
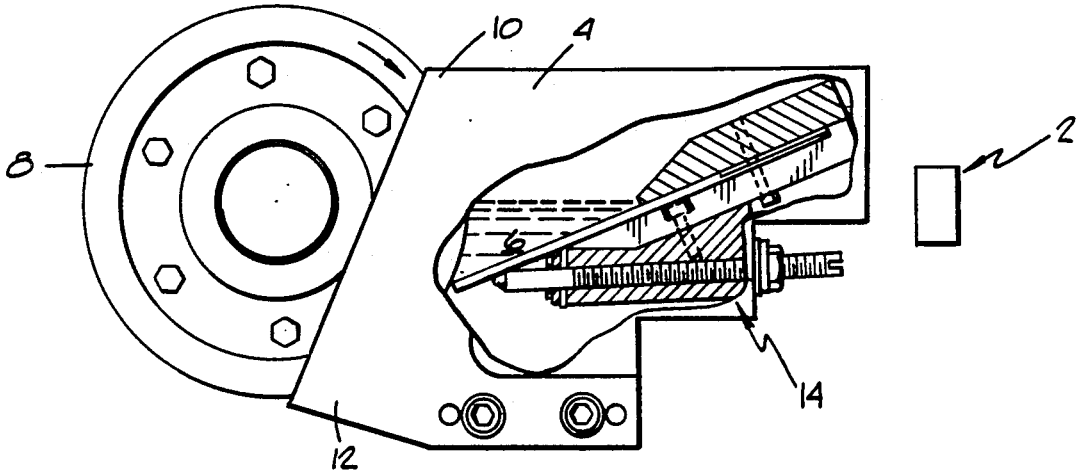
FIG. 1 (PRIOR ART)
FIG. 1 is a side elevational view of a fountain roll and assembly of the prior art.

In FIG. 1, there is illustrated a fountain roll and assembly 2 of the prior art, such as U.S. Pat. No. 4,441,418, wherein a housing 4 is mounted at a fixed location and has an supply of ink 6 enclosed therein. A fountain roll 8 is rotatably mounted so that it enters the housing 4 at an upper portion 10 thereof and leaves the housing 4 at a lower portion 12 thereof As the fountain roll 8 passed through the supply of ink 6, a coating of ink is deposited thereon and adjustable doctor blade means 14 remove excess ink therefrom just before the coated portion of the fountain roll 6 is leaving the housing 4.

The preferred embodiment of the invention is illustrated in the FIGS. 2–7 and comprises a fountain roll and assembly 20 which is mounted on a pair of spaced apart fixedly mounted frame members 22 and 24. Pan means 26 are adjustably mounted on the frame members 22 and 24, described below, so that the level of the supply of ink in the pan means 26 is maintained substantially in a horizontal plane. A fountain roll 28 having a generally cylindrical outer peripheral surface 30 is rotatably mounted on the frame members 22 and 24 so that, as the fountain roll 28 rotates, a lower portion 32 (FIG. 6) is immersed in the supply of ink 34. The fountain roll 28 is rotated in the direction indicated by the arrow 36 so that the outer peripheral surface 30 is moving generally in a downward direction as it enters the supply of ink 34 and is moving generally in an upward direction as it leaves the supply of ink 34 with an excessive coating of ink on the outer peripheral surface thereof. Doctor blade means 38 are provided and are located to be spaced slightly from the outermost portion 40 of the outer peripheral surface 30 as it moves in the upward direction to remove excess ink from the outer peripheral surface 30 and to leave an even layer of ink thereon. The horizontal cross-sectional configuration of the pan means 26 is substantially larger than the horizontal cross-sectional configuration of the fountain roll 28 and the doctor blade means 38 so all of the removed excess ink falls back into the supply of ink 34. A ductor roll 44 is rotatably mounted and is rotated in the direction of the arrow 46 by contact with the fountain roll 28 and is oscillated in directions indicated by the arrow 48 so that it can be moved into and out of contact with the layer of ink so as to remove a portion of such ink.

Figure 3:
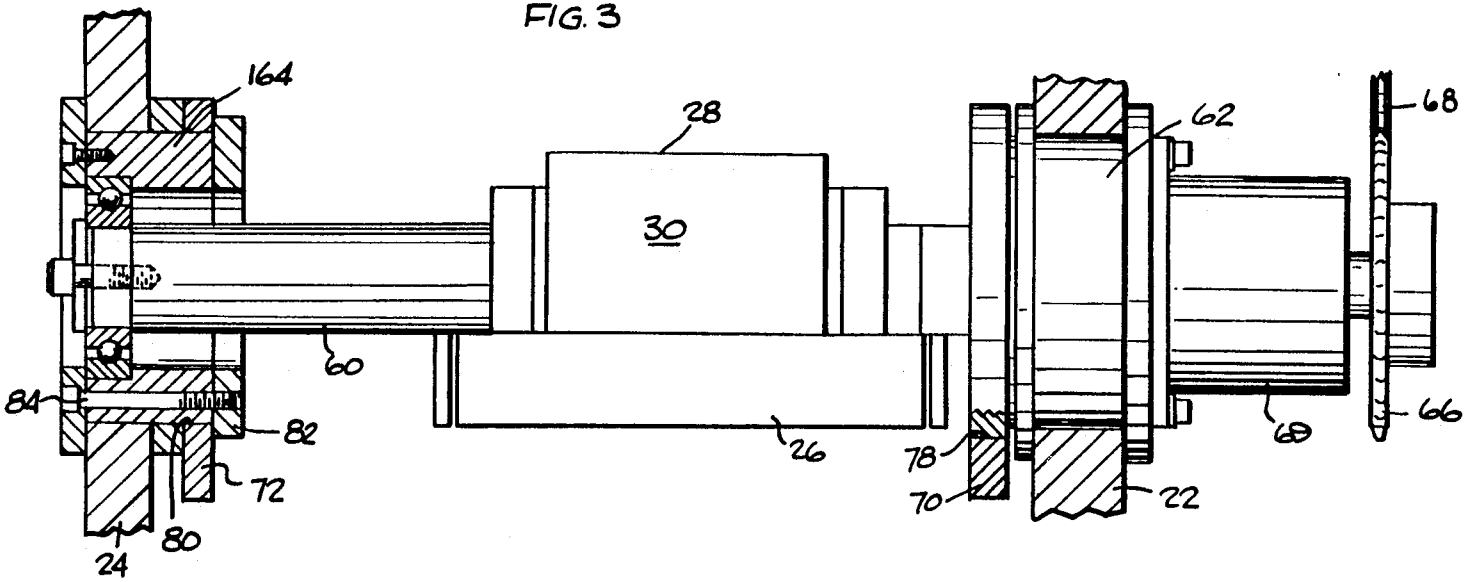
FIG. 3 is a rear elevational view of FIG. 2 and illustrating the mounting thereof.

As illustrated in FIG. 3, the fountain roll 28 is mounted on a shaft 60 for rotation therewith which shaft 60 is rotatably mounted in a bearing housing 62 mounted on the frame member 22 and a bearing housing 64 mounted on the frame member 24. A sprocket 66 is mounted on the shaft 60 for rotation therewith and is rotated by a drive chain 68 which is moved by conventional means (not shown). A gear reducer 69 is used to rotate the shaft 60 at a relatively slow speed.

Figure 2:
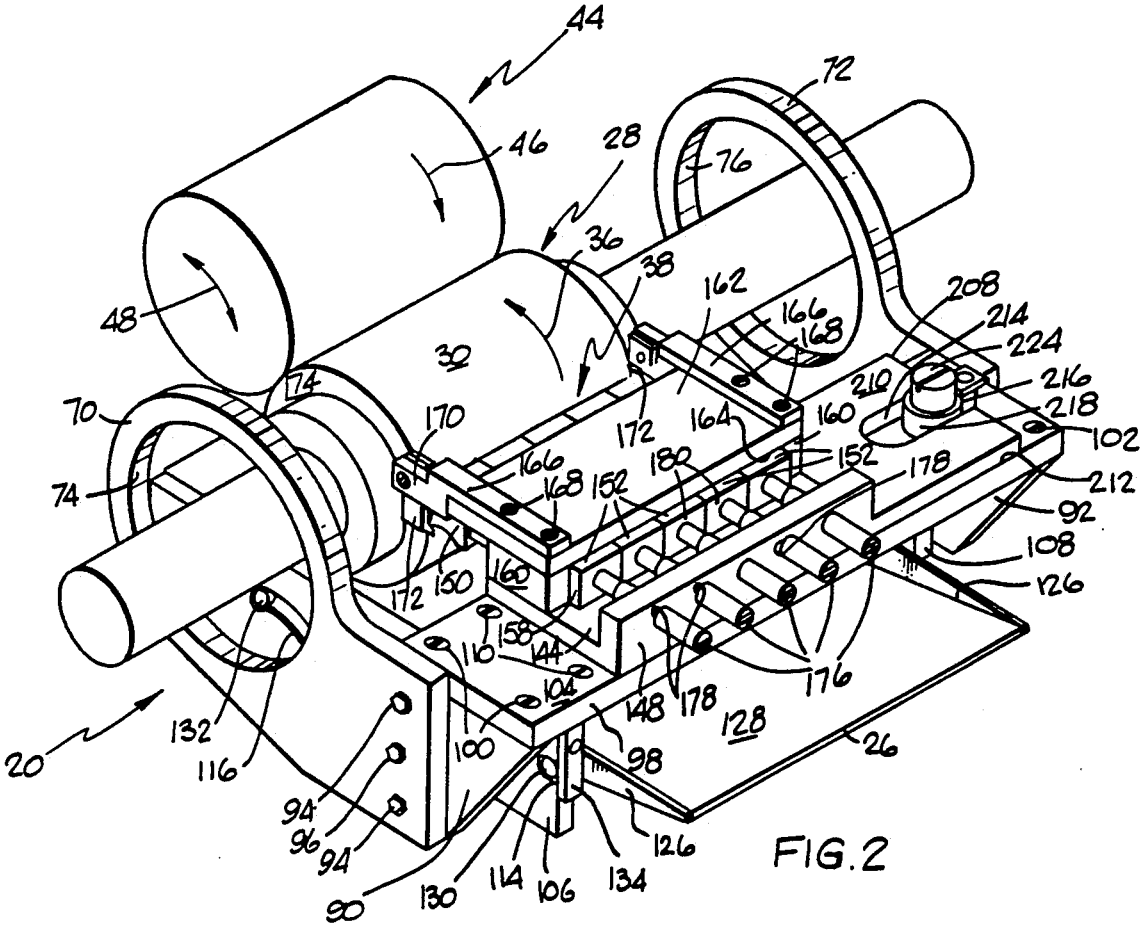
FIG. 2 is a perspective view of the preferred embodiment of the fountain roll and assembly of this invention.
Figure 4:
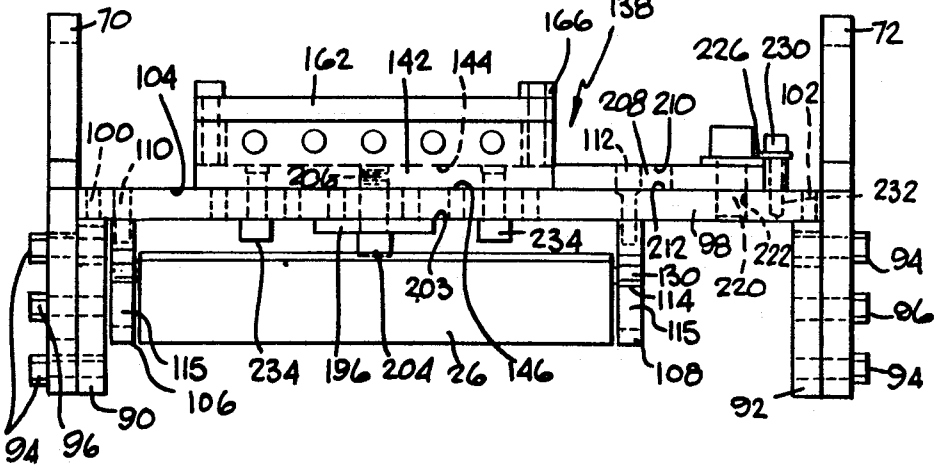
FIG. 4 is a front elevational view of a portion of FIG. 2.

The adjustable support means for supporting the pan means 26 and the doctor blade means 38 is illustrated in FIGS. 2–4. A pair of oppositely located support members 70 and 72 each having a generally cylindrical inner surface 74 and 76 are mounted on generally cylindrical outer surfaces 78 and 80 on the bearing housings 62 and 64. The diameter of each of the generally cylindrical inner surfaces 74 and 76 is slightly greater than the diameter of each of the generally cylindrical outer surfaces 78 and 80 to provide for relative rotational movement therebetween. A clamping member 82 is adjustably mounted on the bearing housing 64 by threaded bolts 84 so it can be moved into and out of clamping engagement with the support member 72.

A pair of support ledges 90 and 92 are secured to the support members 70 and 72 by dowell pins 94 and threaded bolts. A support beam 98 extends between the support members 70 and 72 and is secured to the upper surfaces of the support ledges 90 and 92 by threaded bolts 100 and 102. The support beam 98 has a generally planar upper surface 104. A pair of spaced apart downwardly depending support panels 106 and 108 are secured to the support beam by threaded bolts 110 and 112. Each of support panels 106 and 108 has a first slot 114, FIG. 7, extending in a linear direction and having an opening in the front surface 115 of each support panel 106 and 108 and a second slot 116 having an opening in the bottom surface 117 of each support panel 106 and 108 and having an upwardly inclined portion 118 and a horizontal portion 120 the end of which is located closer to the rear surface 121 than to the front surface 115. The pan means 26 has a generally rectangularly shaped body member having a bottom portion 122, FIG. 6, a vertical rear wall 124 and two vertical sidewalls 126 extending upwardly from the bottom portion 122 and an inclined front wall 128 extending upwardly from the bottom portion 122. A first dowel 130 and a second dowel 132 are secured to the outer surfaces of each sidewall 126. The pan means 26 is assembled by inserting the second dowels 132 into the second slots 116 and moving them over the inclined portion 118 to the horizontal portion 120. The pan means 26 is then moved over the horizontal portion 120 and at the same time the first dowels 130 are moved into the first slots 114. A locking lever 134 is then moved to cover the first slots 114.

The doctor blade means 38 are illustrated in FIGS. 2, 4 and 6 and comprise a support block 138 mounted on the upper surface 104 of the support beam 98 and having a base member 142 having generally planar upper 144 and lower 146 surfaces and an upwardly extending flange portion 148. A plurality of doctor blades 150 have elongated body portions 152 each having a generally planar bottom surface 154 and a generally planar top surface 156 and generally planar side surfaces 158 which are in a side-by-side contacting relationship between a pair of spacer blocks 160 integral with the base member 142. A plate member 162 has a generally planar bottom surface 164 in contact with the top surfaces 156 of the body portions 152 and the spacer blocks 160. A pair of elongated securing bars 166 are mounted on the plate member 162 and threaded bolts 168 pass through openings in the securing bars 166 and the plate member 162 and are threaded in openings in the spacer blocks 160. Each of the securing bars 166 has an extension member 170 on which a flexible doctor blade 172, formed from a plastic material, is mounted so as to remove ink from the end wall 174 of the fountain roll 28. A plurality of threaded bolts 176 are in threaded engagement with threaded openings 178 in the flange portion 148 and with threaded openings 180 in each body portion 152. In a manner that is conventional in the arts, the pitch of the threads in openings 180 and the front portions of the threaded bolts 176 differs from the pitch of the threads in the openings 178 and the back portions of the threaded bolts 176 so that fine adjustments of the doctor blades 150 can be made.

Figure 5:
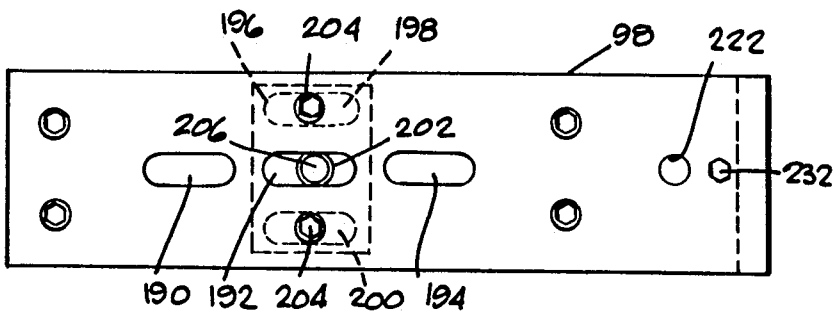
FIG. 5 is a top plan view of a portion of FIG. 4.

The support block 138 is mounted on the upper surface 104 for lateral and pivotal adjustment as illustrated in FIGS. 4–6. A plurality of linearly extending slots 190, 192 and 194 are formed in the support beam 98 wherein the longitudinal axis of the slots 190, 192 and 194 are in alignment. A bottom plate 196 has two spaced apart linearly extending slots 198 and 200 and a central opening 202 formed therein. The bottom plate 196 is mounted on the lower surface 203 of the support beam 98 by threaded bolts 204, FIG. 6, each having a shank portion extending through one of the linearly extending slots 198 and 200 and threadedly engaged in an opening in the lower surface 203 and an enlarged head portion for engaging the portions of the bottom plate 196 defining the linearly extending slots 198 and 200 to hold the support block 138 in the adjusted position. A pin 206 projects downwardly from the lower surface 146 of the base member 142 and passes through the linearly extending slot 192 and the central opening 202. The bottom plate 196 is mounted on the support beam 98 so that the linearly extending slots 190, 192, 194, 198 and 200 are originally in a parallel relationship. An integral lever 208, FIGS. 2 and 4, projects outwardly from the base member 142 and has generally planar upper 210 and lower 212 surfaces with the lower surface 212 thereof being in contacting relationship with the upper surface 104 of the support beam 98. A linearly extending open ended slot 214 is formed in the lever 208. An eccentric member 216 having an eccentric peripheral surface 218 is integral with a shaft 220 having a generally cylindrical outer surface and is located in an opening 222 in the support beam 98 having a generally cylindrical inner surface so that the eccentric member 216 is rotatably mounted on the support beam 98. The eccentric member has a slotted head portion 224 so that it may be easily rotated. The eccentric member 216 is held in an adjusted position by a locking plate 226 bearing against the eccentric member 216 and a headed threaded bolt 230 threaded into a threaded opening 232 in the support beam 98 to apply a holding force on the locking plate 226. Threaded bolts 234 have shank portions extending through one of the linearly extending slots 190 and 194 and are threadedly engaged in threaded openings in the lower surface 146 of the base member 142 and have enlarged head portions for engaging the portions of the support beam 98 defining the slots 190 and 194 to hold the support block 138 in the adjusted position. The shank portions of the threaded bolts 234 are sufficiently smaller than the width of the slots 190 and 194 so as to allow limited pivotal movement of the support block 138 through an arc of about 0.25 degrees.

In operation, the support members 70 and 72 of the fountain roll and assembly 20 are mounted on the cylindrical outer surfaces 78 and 80 of the bearing housing 62 and 64 using the clamping member 82 to hold the pan means 26 so that the ink supply 34 will be level and the fountain roll 28 is generally opposite to the doctor blades 150. The threaded bolts 204 and 234 are loosened and the lateral adjustment of the support block 138 is made to locate the doctor blades 150 directly opposite to the fountain roll 28. The threaded bolts 204 are then tightened so that the pin 206 in the opening 202 holds the support block 138 in its laterally adjusted position. The eccentric member 216 is then rotated to pivot the support block 138 so that the doctor blades 150 are parallel to the peripheral surface 30 of the fountain roll 28. The threaded bolts 234 are then tightened to hold the support block 138 in its adjusted position. The doctor blades 150 are then adjusted relative to the peripheral surface 30 of the fountain roll 28 by rotating the threaded bolts 176. The flexible doctor blades 172 are then mounted on the extension members 170. As the peripheral surface 30 rotates through the ink supply 34, it picks up a coating of ink and as this coating passes the doctor blades 150, the excessive ink is removed to leave an even layer of ink on the peripheral surface 30. The removed excessive ink falls back into the ink supply 34. Also, the flexible doctor blades 172 remove the ink that is on the end walls 174 of the fountain roll 28 and return such ink to the ink supply 34. At periodic intervals, the ductor roll 44 is moved into contact with the layer of ink on the peripheral surface 30 to remove a portion of such layer of ink.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A fountain roll and assembly for a can decorating apparatus comprising:

a pair of spaced apart fixedly mounted frame members;

pan means for holding a supply of ink;

adjustable support means for adjustably supporting said pan means on said frame members so as to maintain the level of said supply of ink in a plane substantially parallel to the horizontal;

a fountain roll having a generally cylindrical outer peripheral surface for contacting said supply of ink;

mounting means for mounting said fountain roll for rotation about a fixed axis and located so that the lower portion of said outer peripheral surface of said fountain roll as it rotates is immersed in said supply of ink so as to provide a coating of ink on said outer surface;

mounting means for rotating said fountain roll so that said outer peripheral surface is moving upwardly when it leaves said supply of ink;

doctor blade means for contacting said coating of ink on said outer peripheral surface of said fountain roll after it leaves said supply of ink to remove excess ink from said outer peripheral surface and to leave an even layer of ink on said outer peripheral surface;

means for supporting said doctor blade means for movement in at least one linear direction and also in another linear direction perpendicular to said one linear direction;

adjusting means for moving said doctor blade means at least in one linear direction and also in another linear direction perpendicular to said one linear direction;

said pan means having a horizontal cross-sectional configuration that is substantially larger than the horizontal cross-sectional configuration of said fountain roll and said doctor blade means so that all of said removed excess ink falls back into said pan means; and a rotatable and oscillatory ductor roll mounted so that it can be moved into and out of contact with said layer of ink on said outer peripheral surface.

2. The invention as in claim 1 wherein:

said ductor roll being rotated by said fountain roll when it moves into contact with said layer of ink.

3. The invention as in claim 1 wherein said adjustable support means comprises:

a pair of oppositely located support members having at least one portion thereof defined by a generally cylindrical inner surface which is mounted for engagement with a generally cylindrical outer surface secured to each of said frame members;

each of said generally cylindrical inner surfaces having a diameter slightly greater than the diameter of each of said generally cylindrical outer surfaces so as to be rotatably mounted thereon;

rotation prevention means for holding at least one of said support members at a desired location;

a support beam extending between and mounted on said support members;

a pair of spaced apart, downwardly depending support panels secured to said support beam;

each of said support panels having a front surface and a rear surface; and pan mounting means for mounting said pan means on said support panels.

4. The invention as in claim 3 wherein said pan means comprises:

a generally rectangularly shaped fluid impermeable body member having a bottom portion, a vertical rear wall and two vertical sidewalls extending upwardly from said bottom portion; and one inclined front wall extending upwardly from said bottom portion.

5. The invention as in claim 4 wherein:

each of said walls having an upper edge; and all of said upper edges lie in a common plane.

6. The invention as in claim 4 wherein said pan mounting means comprises:

a first open ended slot extending inwardly in a linear direction from said front surface of each of said support panels;

a second open ended slot extending upwardly from a bottom surface;

said second open ended slot having a first portion which is inclined to the horizontal and a second portion for supporting said pan means the end of which is located closer to said rear surface of each of said support panels than to each of said front surfaces;

a pair of spaced apart dowels projecting outwardly from each of an opposite pair of said vertical sidewalls for mating engagement in said first and second open ended slot s so that one of each pair of said dowels may be placed in said second open ended slots and moved in the inclined direction and the other of each pair of dowels may be placed in said first open ended slots so that said pan means may be moved in a linear direction toward said rear surface; and locking means for holding said dowels in said first and second open ended slots.

7. The invention as in claim 1 wherein said means for supporting said doctor blade means comprises:

a pair of oppositely located support members secured to each of said frame members;

a support beam extending between and mounted on said support members;

said doctor blade means comprises a plurality of doctor blades mounted in side-by-side contacting relationship;

said adjusting means comprises individual linear adjusting means for moving each of said plurality of doctor blades in said one linear direction;

unit linear adjusting means for moving said plurality of doctor blades as a unit in said another linear direction that is substantially perpendicular to said one linear direction of each of said plurality of doctor blades; and pivotal adjusting means for permitting pivotal movement of said plurality of doctor blades as a unit.

8. The invention as in claim 7 wherein said individual linear adjusting means comprises:

holding means for holding said plurality of doctor blades in said side-by-side contacting relationship and for preventing rotational movement thereof;

an adjusting screw threadedly engaged in each of said plurality of doctor blades;

a support block mounted on said support beam;

linear movement preventing means for preventing linear movement of said support block; and each of said adjusting screws being threadedly mounted in said support block so that rotational movement of each of said adjusting screws moves the associated one of said plurality of doctor blades back or forth in a linear direction.

9. The invention as in claim 7 wherein said unit linear adjusting means comprises:

a support block mounted on said support beam;

said support beam having generally planar upper and lower surfaces;

holding means connected to said support block for holding said plurality of doctor blades in said side-by-side relationship;

said support block having at least a base member having a generally planar lower surface adapted to contact said generally planar upper surface of said support beam;

a linearly extending slot in said support beam;

a pin projecting downwardly from said generally planar lower surface of said support block and passing through said linearly extending slot in said support beam when said support block is positioned on said support beam;

a bottom plate having a pair of spaced apart linearly extending slots and a central opening formed therein;

mounting means for mounting said bottom plate on said generally planar lower surface of said support beam so that said linearly extending slots are in parallel relationship and said pin passes through said central opening; and said mounting means comprising a threaded bolt having a shank portion extending through each of said linearly extending slots in said bottom plate and threadedly engaged in an opening in said generally planar lower surface of said support beam and having enlarged head portions for bearing against the portions of said bottom plate defining said linearly extending slots to hold said support block in position after the linear adjustment has been made.

10. The invention as in claim 9 wherein said pivotal adjusting means comprises:

a lever projecting outwardly from said base member and having a generally planar lower surface in contact with said generally planar upper surface of said support beam;

said lever having opposite side surfaces and an end surface;

an open ended slot in said lever extending inwardly from said end surface;

an eccentric adjusting member rotatably mounted in said support beam and located in said slot;

said eccentric adjusting member having an eccentric outer surface adapted to contact portions of said open ended slot; and rotating means for rotating said eccentric adjusting member to pivot said support block around said pin.

11. The invention as in claim 10 wherein said individual linear adjusting means comprises:

said holding means preventing rotational movement of said doctor blades;

an adjusting screw threadedly engaged in each of said plurality of doctor blades;

linear movement preventing means for preventing linear movement of said support block; and each of said adjusting screws being threadedly engaged in said support block so that rotational movement of each of said adjusting screws moves the associated one of said plurality of doctor blades back or forth in a linear direction.

12. The invention as in claim 11 and further comprising:

said base member having a generally planar upper surface;

each of said doctor blades having generally planar upper and lower surfaces, with said generally planar lower surfaces in contacting relationship with said generally planar upper surface of said base member; and wherein;

said holding means comprises:

a plate member having a generally rectangular configuration with generally planar top and bottom surfaces, front and rear surfaces and opposite side surfaces;

a pair of spaced apart spaced blocks integral with said base member and having generally planar top surfaces in contacting relationship with portions of said bottom surface of said plate member so that other portions of said bottom surface of said plate member are in contacting relationship with said upper surfaces of said plurality of doctor blades; and securing means for securing said plate member on said spacer blocks.

13. The invention as in claim 12 and further comprising:

said fountain roll having generally planar annular opposite end portions; and additional doctor blades mounted on said securing means for removing ink from said end portions and return it to said supply of ink.

14. The invention as in claim 13 wherein:

said ductor roll being rotated by said fountain roll when it moves into contact with said layer of ink.

15. The invention as in claim 14 wherein said adjustable support means comprises:

a pair of oppositely located support members having at least one portion thereof defined by a generally cylindrical inner surface which is mounted for engagement with a generally cylindrical outer surface secured to each of said frame members;

each of said generally cylindrical inner surfaces having a diameter slightly greater than the diameter of each of said generally cylindrical outer surfaces so as to be rotatably mounted thereon;

rotation prevention means for holding at least one of said support members at a desired location;

a support beam extending between and mounted on said support members;

a pair of spaces apart, downwardly depending support panels secured to said support beam;

each of said support panels having top and bottom surfaces; front and rear surfaces and opposite side surfaces;

each of said support panels having a front surface and a rear surface; and pan mounting means for mounting said pan means on said support panels.

16. The invention as in claim 15 wherein said pan means comprises:

a generally rectangularly shaped fluid impermeable body member having a bottom portion, a vertical rear wall and two vertical sidewalls extending upwardly from said bottom portion; and one inclined front wall extending upwardly from said bottom portion.

17. The invention as in claim 16 wherein:

each of said walls having an upper edge; and all of said upper edges lie in a common plane.

18. The invention as in claim 17 wherein said pan mounting means comprises:

a first open ended slot extending inwardly in a linear direction from said front surface of each of said support panels;

a second open ended slot extending upwardly from a bottom surface;

said second open ended slot having a first portion which is inclined to the horizontal and a second portion for supporting said pan means the end of which is located closer to said rear surface of each of said support panels than to each of said front surfaces;

a pair of spaced apart dowels projecting outwardly from each of an opposite pair of said vertical sidewalls for mating engagement in said first and second open ended slots so that one of each pair of said dowels may be placed in said second open ended slots and moved in the inclined direction and the other of each pair of dowels may be placed in said first open ended slots so that said pan means may be moved in a linear direction toward said rear surfaces; and locking means for closing said first open ended slot.

* * * * *